United States Patent [19]

Gentry et al.

[11] 4,367,055

[45] Jan. 4, 1983

[54] SUBSEA FLOWLINE CONNECTION YOKE ASSEMBLY AND INSTALLATION METHOD

[75] Inventors: Larry L. Gentry, Sunnyvale; Herbert H. Moss, Cupertino, both of Calif.; Narayan N. Panicker, Grand Prairie; Irvin R. Yancey, Irving, both of Tex.

[73] Assignee: Mobil Oil Corporation, New York, N.Y.

[21] Appl. No.: 220,323

[22] Filed: Dec. 29, 1980

[51] Int. Cl.[3] ..... E21B 17/01; F16L 1/04

[52] U.S. Cl. ..... 405/169; 166/345; 166/359

[58] Field of Search ..... 405/169, 195; 166/338, 166/343, 345, 347, 350, 359, 367; 175/7

[56] References Cited

U.S. PATENT DOCUMENTS

| | | | |
|---|---|---|---|
| 3,233,667 | 2/1966 | Van Winkle | 166/359 X |
| 3,373,807 | 3/1968 | Fischer et al. | 166/345 X |
| 4,090,560 | 5/1978 | Hoel et al. | 405/169 X |
| 4,102,146 | 7/1978 | Dietrich | 405/169 |
| 4,142,584 | 3/1979 | Brewer et al. | 166/359 |
| 4,194,568 | 3/1980 | Buresi et al. | 166/359 X |

*Primary Examiner*—David H. Corbin

*Attorney, Agent, or Firm*—Charles A. Huggett; Michael G. Gilman; James F. Powers, Jr.

[57] ABSTRACT

A marine compliant riser system is provided for attaching a flexible flowline to a buoyed conduit riser section. The improved system includes a novel yoke assembly for receiving flexible flowline with a means for retaining a terminal portion of the flexible flowline at a substantially vertical catenary departure angle. Pivotally-mounted loading gates or a yoke beam support the flexible flowlines during installation and/or replacement on the yoke. Connection means are mounted on the buoy section for establishing fluid communication between the flexible flowline and conduit at the buoyed riser section.

An installation method is disclosed for completing the improved riser system in deepwater. This system is particularly adapted for oil and gas flowlines, service lines, hydraulic control and electrical conduits for connecting a subsea wellhead or production gathering eqiupment to a surface facility.

6 Claims, 17 Drawing Figures

SUBSEA FLOWLINE CONNECTION YOKE ASSEMBLY AND INSTALLATION METHOD

BACKGROUND OF THE INVENTION

The present invention relates to a marine riser system and method of installation. In particular, it relates to a method and apparatus for connecting flexible flowlines between a submerged fixed-position riser section for connecting a surface facility to a subsea wellhead or manifold system.

In the production of fluid hydrocarbons from deep-water marine oil and gas deposits, a fluid communication system from the marine bottom to the surface after production is required. Such a system, commonly called a production riser, usually incudes multiple conduits through which various produced fluids are transported to and from the surface, including oil and gas production lines, service and hydraulic control lines and electrical imbilicals.

In offshore production, a floating facility can be used as a production and/or storage platform. Since the facility is constantly exposed to surface and sub-surface conditions, it undergoes a variety of movements. In such a zone of turbulence, heave, roll, pitch, drift, etc., may be caused by surface and near surface conditions. In order for a production riser system to function adequately with such a facility, it must be sufficiently compliant to compensate for such movements over long periods of operation without failure.

One example of such a marine riser is the compliant riser system disclosed in U.S. Pat. No. 4,182,584. This compliant riser system includes (1) a lower section which extends from the marine bottom to a vertically-fixed position just below the zone of turbulence that exists near the surface of the water, and (2) a flexible section which is comprised of flexible flowlines that extend from the top of the rigid section, through the turbulent zone, to a floating vessel on the surface. A submerged buoy is attached to the top of the rigid section to maintain the rigid section in a substantially vertical position within the water. With riser systems of this type difficulties could arise in installing and maintaining the flexible conduits. The flexible flowline is attached to a rigid section such that the end portion adjacent the fixed or rigid portion is not attached at a normal catenary departure angle. This can result in localized stresses, causing undue wear in the flexible flowline at its terminal hardware. If a natural catenary shape is assumed by the flowline, it approaches the fixed position section pointed upwardly, nearly vertical at its point of suspension.

It is an object of this invention to provide a compliant riser system in which the flexible section assumes a substantially vertical departure angle at its terminal portion, whereby the flexible section conduits are supported longitudinally with relatively low transverse force vectors. It is another object to provide a unique yoke assembly for connecting a fexible flowline bundle to a submerged riser support. It is a further object of this invention to provide a method for connecting an ocean floor base (e.g., a subsea wellhead or the like) to a marine surface facility through a compliant riser having a buoyed lower riser section extending from the marine bottom toward the surface facility and terminating at a predetermined vertical position below turbulent water. This can be achieved with a releasably mounted yoke assembly which provides terminal support at one end of a catenary flowline during installation.

SUMMARY OF THE INVENTION

A novel marine compliant riser system has been designed for connecting a subsea hydrocarbon source to a floating surface facility through a lower multi-conduit riser section to a submerged buoy section located below a turbulent water zone. A flexible flowline comprises a plurality of flexible conduits for fluid connection between corresponding lower riser conduits and the surface facility. The improved system comprises a yoke assembly mounted on the buoy section including beam means for receiving a plurality of flexible conduit terminations in spaced-apart recesses.

To the yoke beam a plurality of pivotally-mounted loading gates are operatively connected adjacent respective recesses. Each of gates has annular termination-supporting means with side access to permit lateral loading of a corresponding flexible conduit onto the gate for supporting the flexible conduits in a substantially vertical position. To retain the flexible conduits in position for connection to the lower riser conduits, means may be provided for closing and locking each of said locking gates.

A connection assembly connects upwardly directed flexible conduits with corresponding upwardly-directed lower riser conduits in fluid flow relationship.

Hydraulic jack means may be employed for lifting the flexible conduit termination from the loading gates into operative connection with a corresponding vertically-aligned connection means.

The yoke assembly may be installed with one or more flexible flowlines attached. The system permits individual replacement and/or installation on the buoy-mounted yoke. Advantageously, the yoke assembly and yoke locking means receive the flexible conduits in linear spaced relationship. Supported in predetermined positions between the yoke assembly and lower riser sections are a plurality of inverted U-shaped connection assemblies, which provide means for operatively connecting the flexible conduits to corresponding flowlines in the fixed vertical conduit section. In a typical riser system according to this invention, these intermediate connection assemblies may be inserted into respective flexible flowline connectors adjacent the yoke assembly. Hydraulically actuated connectors may be employed for operatively connecting the U-shaped connection assemblies between corresponding flexible flowlines and conduits at the buoy section.

During installation the flexible flowline bundle is assembled with parallel flexible conduits and one end may be connected to a surface facility, such as a production vessel or the like. A substantially unhindered catenary configuration is obtained by spreading and retaining the flexible flow line bundle in spaced parallel relationship while permitting longitudinal movement of the individual flowlines, hydraulic supply and electrical umbilicals. The novel yoke assembly may be attached at a lower end of the flexible flow line bundle to the top of the lower riser section for supporting the flexible flow line bundle in catenary arrangement with the flexible conduits being disposed for pendant end connection. The flexible conduits may be attached to the yoke before mounting on the buoy section, or the individual conduits may be installed after the yoke has been mounted on the buoy section. After aligning individual connection assemblies for fluid connection with respective flexible conduits on the yoke assembly and rigid conduits at the buoyed casing, the flexible conduits are connected to the fixed position lower riser section and supported thereby.

The apparatus and installation methods are particularly advantageous in providing multiple flowline compliant risers which are individually supported in a relatively unstressed position. These and other advantages and features will be seen in the following drawing and description of preferred embodiments.

THE DRAWING

DESCRIPTION OF THE PREFERRED EMBODIMENTS

In the following explanation of the invention concept, certain portions of the overall compliant riser system are shown by example merely to illustrate a typical operative embodiment. However, modifications and variations can be made within the scope of the invention. For instance, the surface facility need not be a production vessel, semi-submersible units or floating platforms being viable alternative structures for use with compliant risers, as shown in U.S. Pat. No. 4,098,333. Likewise, the specific structure of the marine bottom connection may be adapted for single wellheads, multi-well gathering and production systems and/or manifolds for receiving and handling oil and gas. Submerged, free-standing lower riser sections need not be rigid conduits, since buoy-tensioned flexible tubing or hoses can be maintained in fixed position when attached to the ocean floor, as shown in U.S. Pat. No. 3,911,688 and French Pat. No. 2,370,219 (Coflexip). The lower riser section extends to a substantially fixed vertical position, while permitting lateral excursion of the buoy portion. The catenary upper section permits both significant horizontal excursion and elevational changes in the surface facility, due to heaving of the surface facility.

Figure 1:
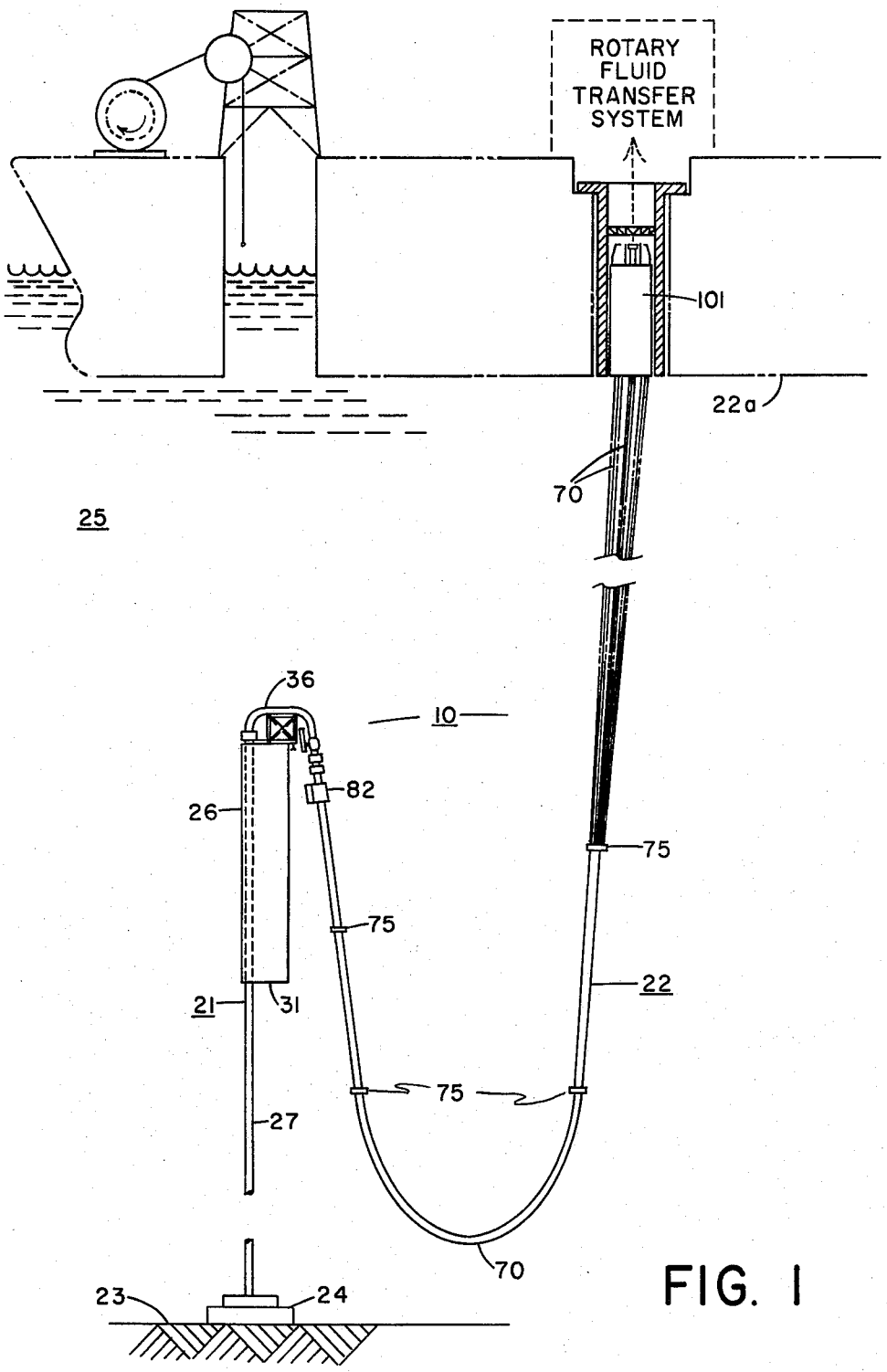
FIG. 1 is a schematic representation of a marine riser system, with a side view of a floating vessel and subsea components.

Referring now to the drawings, FIG. 1 discloses marine compliant riser system 10 in an operational position at an offshore location. The riser system has a lower rigid section 21 and an upper flexible section 22. Lower rigid section 21 is affixed to base 24 on marine bottom 23 and extends upwardly to a point just below turbulent zone 25, which is that zone of water below the surface which is normally affected by surface conditions, e.g. currents, surface winds, waves, etc. Buoy section 26 is positioned at the top of rigid section 21 to maintain rigid section 21 in a vertical position under tension. Flexible section 22 has a plurality of flexible conduits which are operatively connected to respective flow passages in rigid section 21 at buoy section 26. Flexible section 22 extends downwardly from buoy section 26 through a catenary path before extending upwardly to the surface, where it is connected to the floating facility **22*a***.

Lower Rigid Section

As shown in FIG. 1, base portion 24 is positioned on the marine bottom and submerged flowlines from individual wells may be completed thereto. Base 24 may be a wellhead, multi-well completion template, a submerged manifold center, or a like subsea structure. Each submerged flowline terminates on base 24 and preferably has a remote connector, e.g. "stab-in" connector, attached to lower end thereof. As illustrated in FIGS. 1 to 5, rigid section 21 may be constructed with a casing 27, which has a connector assembly (not shown) on its lower end which in turn is adapted to mate with mounted means on base 24 to secure casing 27 to base 24.

Figure 2:
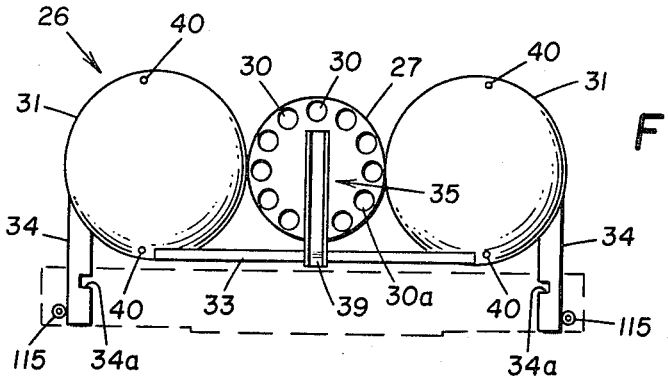
FIG. 2 is a plan view of the buoy portion; with a top connection portion removed.

As shown in FIG. 2, a plurality of individual rigid flowlines or conduits 30, which may be of the same or diverse diameters, are run through guides within or externally attached to casing 27 in a known manner. These are attached via stab-in or screw-in connectors of the submerged flowlines on base 24, providing individual flowpaths from marine bottom 23 to a point adjacent the buoy means at the top of casing 27.

Riser Buoy Section Subsystem

Figure 3:
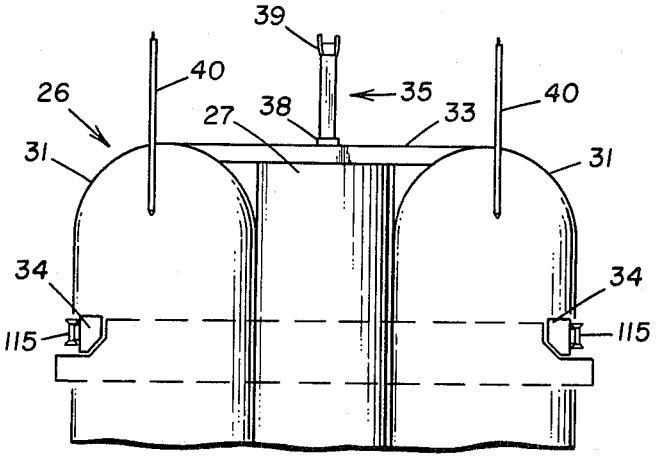
FIG. 3 is a side elevation view of the buoy portion, showing the relationship of the yoke beam in dashed line.

Located at the top of casing 27 is buoy section 26 which is comprised of multiple buoyant chambers 31, affixed diametrically opposite at either side of casing 27. As shown in FIGS. 2 and 3, beam 33 extends between chambers 31 near their upper ends and is attached thereto. Yoke-receiving arms 34 are attached to the outboard edges of chambers 31 and extend horizontally outward therefrom.

Figure 5:
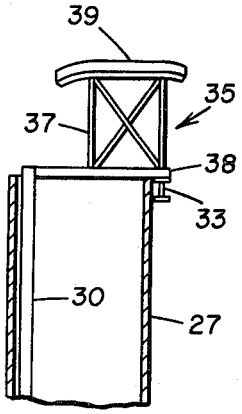
FIG. 5 is a vertical cross-section view of a typical buoy.

Mounted atop casing 27 and affixed to beam 33 on the buoy means are plurality of support structures 35 for retaining inverted U-shaped connection assemblies. Although, for the sake of clarity, only one such support structure 35 is shown in FIGS. 2, 3, and 5 of the drawings, it should be understood that the overall support means includes a similar support structure 35 for each rigid conduit 30 within casing 27. Referring to FIG. 5, a typical support structure 35 is comprised of a vertical frame 37 having a lower mounting element 38 affixed to buoy beam 33 and having a trough 39 secured along its upper surface. Trough 39 is sufficiently large to receive a corresponding U-shaped or "gooseneck" conduit 36.

Figure 4:
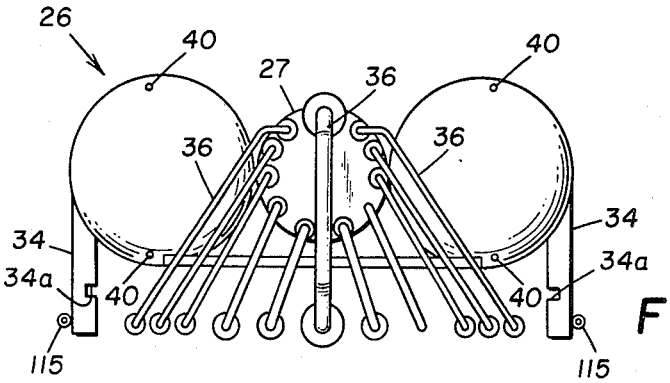
FIG. 4 is a plan view of the buoy section with a top connection assembly attached.

Guide posts 40 are attached to buoyant chambers 31 and extend upard therefrom (as shown in FIGS. 2, 3 and 4) to facilitate installation of the connection assemblies.

Figure 7:
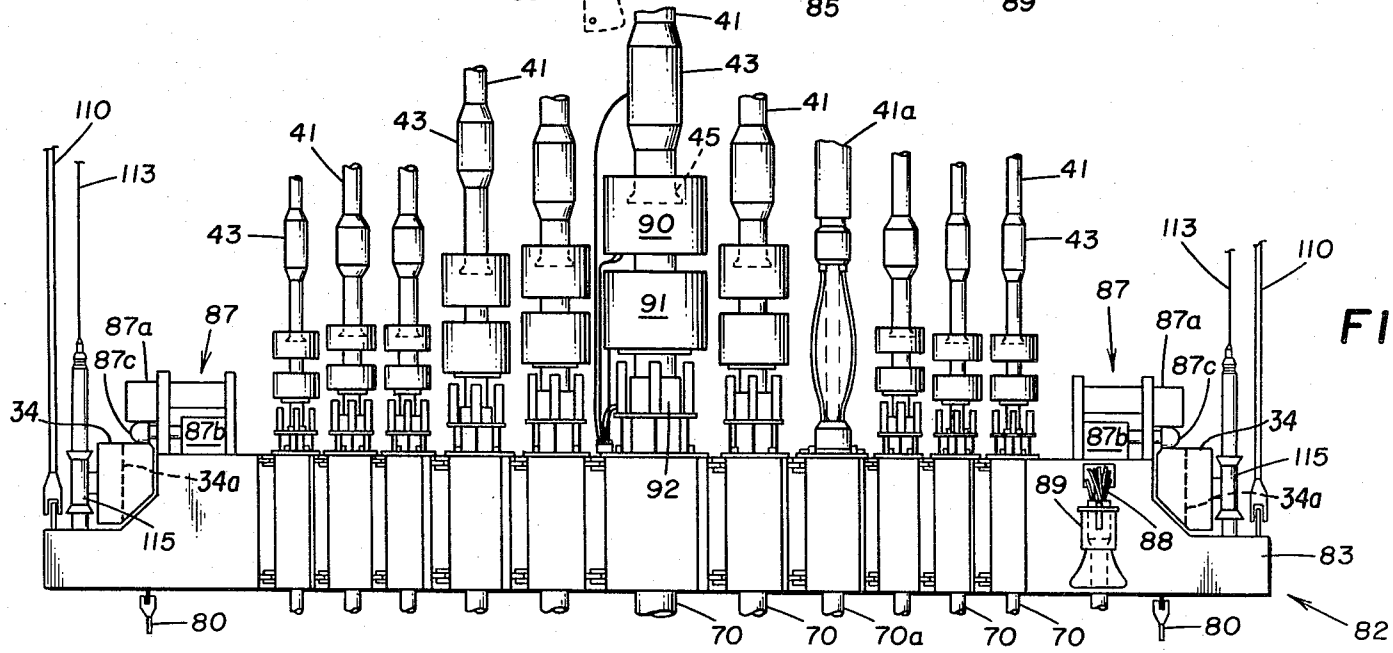
FIG. 7 is an elevation view of the novel yoke assembly, showing the connecting means for establishing fluid communication between the flexible section and connection assemblies.
Figure 9:
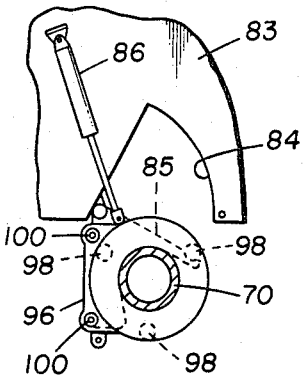
FIG. 9 is a plan view of a yoke recess portion showing installation of a flexible flowline prior to locking.
Figure 11:
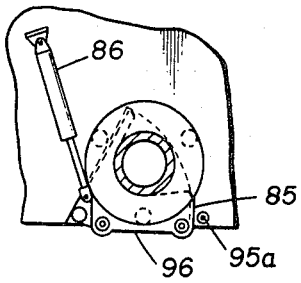
FIG. 11 is a plan view as in FIG. 9, showing the locking means after flowline installation.

A typical connection assembly including gooseneck conduit 36 is shown in FIGS. 1 and 7. Gooseneck conduit 36 is comprised of a length of rigid conduit which is curved downward at both ends to provide an inverted U-shaped flow path. Connector means 42 (e.g. hydraulically-actuated collet connector) is attached to one end of conduit 41 and is adapted to couple conduit 41 fluidly to its respective rigid conduit 30 when gooseneck 36 is lowered into an operable position. The extreme environmental conditions of subsea handling systems may cause frequent equipment failures and repair problems. In order to minimize pollution and loss of product, fail-safe valves are usually employed for all flowlines. Redundant connectors and hydraulic operators are also desirable because of occasional equipment failures. Emergency shut-off valve means may be provided in conduit 41 just above its male end.

Flexible Flowline Section Subsystem

The compliant conduit section 22 (shown in FIG. 1) comprises a plurality of flexible catenary flowlines 70, each adapted to be operatively connected between the surface facility and its respective gooseneck conduit 36 on buoy section 26. The upper end of each flexible flow conduit 70 is attached at 71 to floating facility 22*a* by any suitable means. The preferred flexible flowlines are Coflexip multi-layered sheathed conduits. These are round conduits having a protective outer cover of low-friction material. The flowlines are commercially available in a variety of sizes and may be provided with releasable ends. The ribbon-type flowline bundle restrains the flexible conduits from substantial intercontact and provides sufficient clearance at the spreader beam guides 75 to permit unhindered longitudinal movement. Flexible conduits 70 are retained in parallel alignment or "ribbon" relationship substantially throughout their entire length. Multiple conduits of equal length can be held in this parallel relationship by a plurality of transverse spreader beams 75 longitudinally spaced along flexible conduits 70 (four shown in FIG. 1). In a preferred embodiment the surface end of the flowline bundle is connected to a rotary moonpool plug 101 on a surface vessel 22*a*, with the individual conduits 70 being arranged in a compact, non-linear array, and as a circle.

Yoke Assembly and Connector Subsystem

Figure 6:
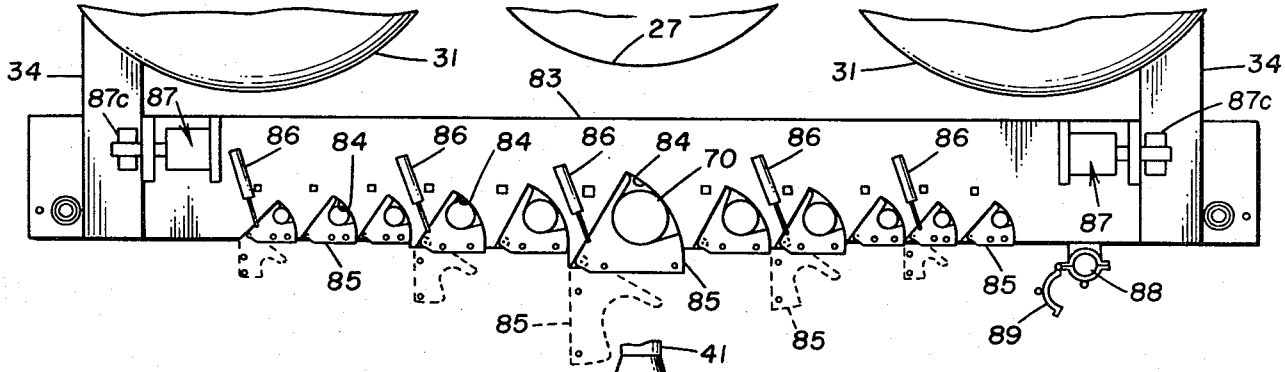
FIG. 6 is a detailed plan view of a yoke assembly for connecting the flexible section to the buoy section.

Yoke assembly 82 (FIGS. 6 and 7) provides means for mounting and connecting flexible conduit section 22 to buoy section 26. Yoke assembly 82 includes an elongated horizontal support member 83. This member may be a hollow steel box beam having a plurality of spaced-apart recesses 84 therein, which receive corresponding flexible flowlines 70 in linear array at horizontally spaced locations. Loading and locking means, such as gates 85 pivotally mounted at recesses 84, secure the terminations of flowlines 70 to the yoke. Hydraulic cylinders 86 actuate gates 85 laterally between an open position (dotted lines in FIG. 6) and a closed locking position. Hydraulic cylinders 86 may be permanently attached on yoke support beam 83 or releasably mounted to be installed by a diver when needed.

Hydraulically-actuated connecting pin assemblies 87 are mounted at opposing ends of support element 83 and are adapted to lock the horizontal yoke support 83 to yoke arms 34 when yoke assembly 82 is in position at buoy section 26. The yoke assembly 82 is attached to the support arms 34 of the buoy section by having a pair of hydraulically-actuated connecting pin assemblies 87 located at opposite ends of the yoke beam 83. This retractable attachment means has opposing retractable members 87*c* adapted to be retained adjacent arm slots 34*a* in spanning relationship. A D-shaped bar configuration and end mating arrangement between the yoke beam ends and support arms 34 permits the entire yoke assembly to fall away from the buoy section, thereby preventing angular distortion and damage to the flexible bundle in the event of attachment means failure or single retraction. Hydraulic line 88 includes a number of individually pressurized conduits for actuating the various mechanisms on yoke assembly 82 and may be attached by means of manual gate 89.

A primary connector 90 (e.g. hydraulically-actuated collet connector) may be mounted on the end of each flexible conduit 70 and adapted to connect flexible conduit 70 remotely to male end 45 of a corresponding gooseneck conduit 41. To assure release of the flexible conduit from buoy section 26 in an emergency situation, an optional back-up or secondary redundant fluid connector 91 may be installed adjacent primary connector 90.

Figure 8:
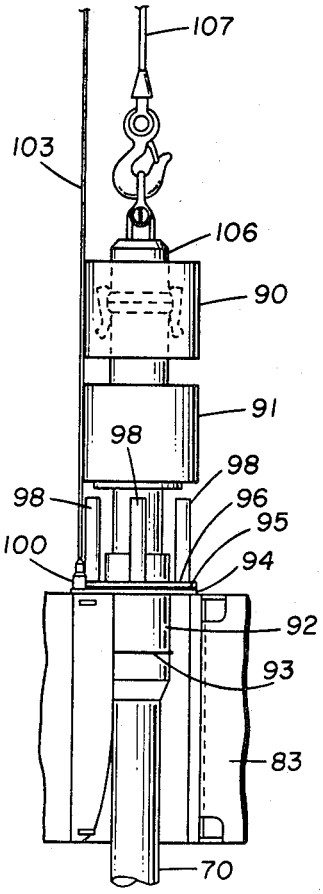
FIG. 8 is a side view of a portion of the yoke assembly with a flexible flowline being installed at a yoke recess with a lowering line.
Figure 10:
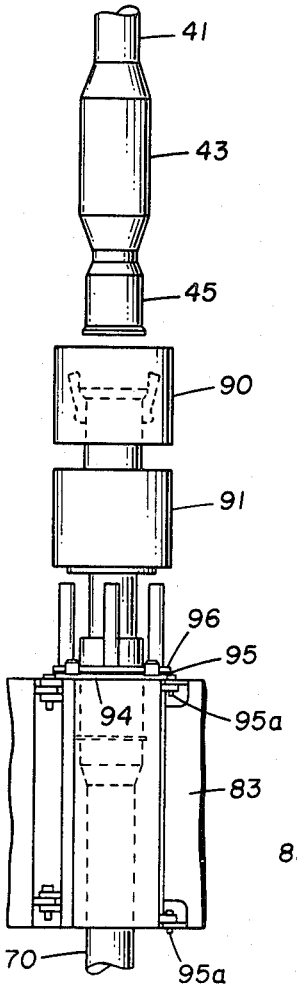
FIG. 10 is a side view similar to FIG. 8 after locking, showing alignment of the connection assembly.
Figure 12:
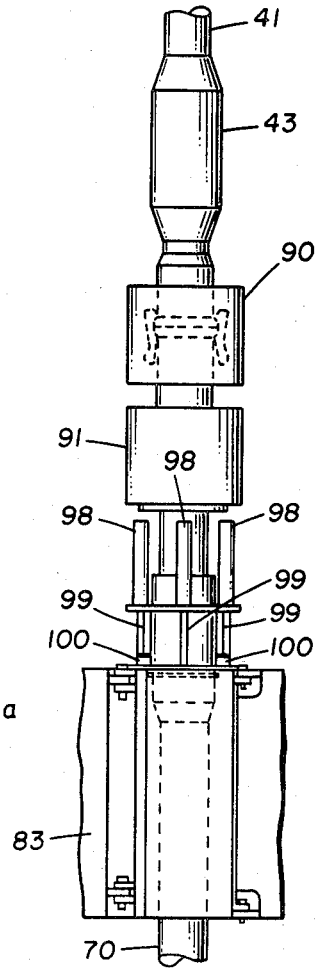
FIG. 12 is a side view as in FIG. 15, showing actuation of the jack assembly for connecting the gooseneck.

As shown in FIG. 8, located below the primary and secondary connectors is a flowline termination including coupling 92, which has a lip 93 thereon. Rotating metal plate 94 and "Delrin" plastic plate 95 are rotatably and slidably mounted on coupling 92, resting on lip 93 until flexible conduit 70 is positioned in yoke 82. Bearing plate 96 is secured to coupling 92 and carries jack means comprising three equally-spaced hydraulically-actuated cylinders 98 which have pistons 99 adapted to extend downwardly to bearing plate 96. With all of the major components having now been described, the method of installing the compliant riser system will follow.

Installation and Operation

To install the compliant riser system 20 of the present invention, lower rigid section 27 with buoy section 26 in place is installed on base 24. Rigid conduits 30 are run into casing 27 and coupled to submerged flowlines on base 24. U.S. Pat. No. 4,182,584 illustrates a technique which can be used to install rigid section 27 and rigid conduits 30. The connection assemblies are lowered on running tools into predetermined positions on buoy section 26. The gooseneck conduit 36 of each connection assembly is positioned so that it will be properly aligned with its respective rigid and flexible conduits.

Referring to FIGS. 14A–14D; one technique for assembling and installing flexible section 22 is disclosed. Flexible conduits 70 and electrical cable 70*a* are stored on powered reels on vessel 22*a*. One end of each flexible conduit 70 and electrical cable 70*a* is connected to a plug 101 which is lowered upside down through moonpool A of vessel 22*a*. By means of line 102, plug 101 can be keelhauled between moonpool A and moonpool B. Alternatively, the moonpool plug or a portion thereof can be pre-installed, with the flexible lines being keelhauled individually and attached. Cables or wires 80 which support spreader beams 75 may be attached to plug 101 and payed out with conduits 70. Spreader beams are assembled onto conduits 70 as they are payed out or each conduit 70 can be separately positioned in its respective guide 77 on beam 75 by a diver after each beam 75 enters in the water. After the plug 100 and/or flexible lines 70 are keelhauled toward moonpool B, yoke assembly 82 can be mounted on the ends of conduits 70 and electrical cables 70*a* as shown in FIGS. 14A–14D.

Figure 14D:
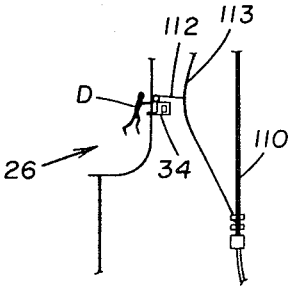
FIGS. 14A to 14D are a schematic representation of the installation sequence for the compliant riser system.
Figure 14C:
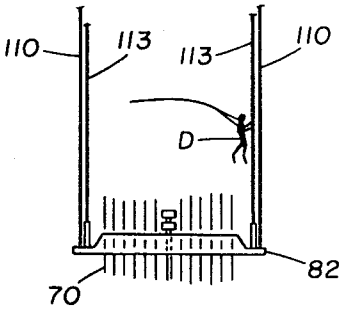
Figure 14B:
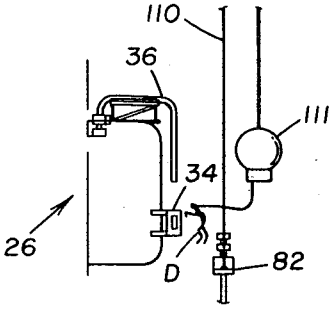
Figure 14A:
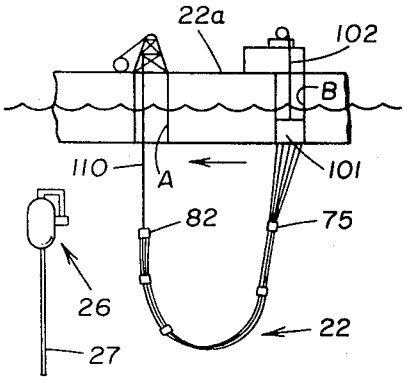

After flexible section 22 is assembled, rotary plug 101 is pulled into moonpool B of vessel 22*a* and affixed therein. Yoke 82 is lowered by means of lines 110 to a position just below yoke support arms 34 on buoy section 26 (FIG. 14B). Diver D exits diving bell 111 and attaches taglines 112 to guidelines 113. By means of winch 114 on buoy section 26 and taglines 112, diver D pulls guidelines 113 into guide shoes 115 (FIG. 7) which are split or hinged to allow lines 113 to enter. Slack is then taken up on lines 113 to draw yoke 82 into position on yoke support arms 14. As yoke 82 is drawn upward, upper support 87*a* of connecting pin assembly 87 (FIGS. 6 and 7) passes through slots 34*a* on support arms 34 (FIGS. 2 and 4). Hydraulic cylinders 87*b* are then actuated to move crossbar 87*c* into engagement between upper support arms 34 thereby locking yoke 82 in position on buoy section 26. Cylinders 98 (FIGS. 8–12) are then actuated to move connector 90 into engagement with male end 45 of gooseneck conduit 36 and connector 90 is actuated to secure the connection between gooseneck conduit 36 and flexible conduit 70. Diver D then makes up the electrical connection between cables 41*a* and 70*a* to complete the installation.

Alternatively, the conduits can be assembled into yoke 82 after it has been positioned in the water. This procedure can be employed for initial installation or replacement of flexible flow lines individually. This includes the steps of (1) guiding an upwardly-directed flexible flowline 70 with its termination onto a pivotal yoke-mounted loading gate, (2) securing the flowline termination on the loading gate 85 and closing the loading gate to lock the flexible flowline onto the gate, (3) aligning a rigid connector 36 over the flowline termination for operative connection therewith, the rigid connector being connected to the lower riser conduit 30 before or after flexible flowline installation; and (4) lifting the flowline termination upwardly into operative connection with the rigid connector by jack means 38 mounted between the flowline termination and the yoke assembly. This technique establishes fluid communication from the subsea well through the fixed riser section and flexible flowline to the surface facility with the flexible flowline depending from the rigid connector at substantially vertical catenary departure angle and with the flowline termination being substantially entirely supported by the rigid connector.

Figure 13:
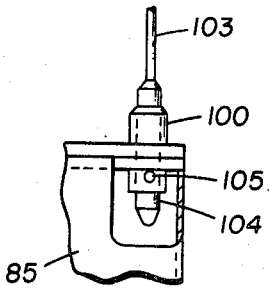
FIG. 13 is a partial detailed side view of a guidewire connection mechanism.

Referring to FIGS. 8–13, gate 85 on yoke 82 is moved to an open position (FIGS. 8 and 9) by hydraulic cylinder 86. Guidelines 103 are attached to loading gate 85 via plugs 104 which extend through hollow positioning pins 100 on gate 85 and are held in place by crosspins 105 (FIG. 13). Guidelines 103 cooperate with openings in rotating plate 94 to provide guidance for conduit 70 into gate 85. Nipple 106 (FIG. 8) is attached to connector 90 and lowering line 107 is attached to nipple 106. Conduit 70 is lowered on guidelines 103 by line 107 onto gate 85, which supports the weight of the flexible flowline until connection is made. Openings in rotating plate 94 engage and receive positioning pins 100 on gate 85. Conduit 70 is then further lowered until bearing plate 96 comes to rest on a low-friction bearing plate 95. Cylinder 86 then closes gate 85 (FIGS. 10 and 11) and lock pins 95*a* may be inserted by a diver to secure the gate. Guidelines 103 may then be removed from gate 85, and nipple 106 released from connector 90 to be retrieved with line 107.

If a conduit 70 needs repair or replacement, it can be individually replaced by disconnecting it from its respective gooseneck conduit 36 and opening its gate 85 on yoke 82. Lowering line 107 is then attached to connector 90 for retrieving the conduit 70. Spreader beams 75 are opened sequentially to remove the defective conduit 70. A replacement conduit 70 may be assembled into flexible section 22 in a manner similar to the installation procedure described above.

In an emergency situation, flexible section 22 can be quickly released from buoy section 26. Each conduit 70 is released from its respective gooseneck conduit 36 by releasing primary connector 90, or if connector 90 fails, by releasing secondary connector 91. Connecting crossbars 87*c* of assemblies 87 are retracted to allow yoke 82 to be released from support arms 34. Assemblies 87 are designed so that if only one bar 87*c* is retracted and the other assembly 87 fails, yoke 82 will fall away at the released end, thereby pulling the failed bar 87*c* as yoke 82 fails.

We claim:

1. In a marine compliant riser system for connecting a subsea hydrocarbon source to a floating surface facility through a lower multi-conduit riser section to a submerged buoy section located below a turbulent water zone and a flexible flowline comprising a plurality of flexible conduits for fluid connection between corresponding lower riser conduits and the surface facility, the improvement which comprises:

a yoke assembly mounted on the buoy section including beam means for receiving a plurality of flexible conduit terminations in spaced apart recesses;

a plurality of pivotally-mounted loading gates operatively connected to the yoke beam adjacent respective recesses, each of said gates having annular termination-supporting means with side access to permit lateral loading of a corresponding flexible conduit onto the gate for supporting the flexible conduits in a substantially vertical position;

means for closing and locking each of said locking gates to retain the flexible conduits in position for connection to the lower riser conduits;

connection assembly means for connecting upwardly directed flexible conduits with corresponding upwardly-directed lower riser conduits in fluid flow relationship; and means for lifting said flexible conduit termination from said loading gates into operative connection with a corresponding vertically-aligned connection means.

2. The compliant riser system of claim 1 wherein the lifting means comprises jack means disposed between the flexible conduit termination and loading gate.

3. The compliant riser system of claim 1 wherein the loading gates have guideline attachment means for lowering the flexible conduit terminations onto respective loading gates.

4. The compliant riser system of claim 1 further comprising means for reversibly locking the loading gates to the yoke beam in a closed position, and reversible hydraulic gate operator means for pivoting the loading gate during connection and disconnection of the flexible conduits.

5. The compliant riser system of claim 1 wherein the yoke assembly comprises a horizontal hollow support beam having a plurality of spaced recesses for receiving flexible conduits, each flexible conduit termination having an enlarged end shoulder which is supported by mounted gate jack means; and at least one hydraulically-actuated connector means mounted on each flexible flowline for establishing fluid communication with the corresponding connection assembly means.

6. A method for connecting a subsea well fluid handling means to a marine surface facility through a compliant riser having a lower riser section extending from the marine bottom toward the surface facility and terminating at a substantially predetermined vertical position below a turbulent water region adjacent a buoy-supported yoke assembly, which comprises:

guiding an upwardly-directed flexible flowline termination onto a pivotal yoke-mounted loading gate;

securing the flowline terminaton on the loading gate;

closing the loading gate to lock the flexible flowline onto the gate;

aligning a rigid connector over the flowline termination for operative connection therewith, said rigid connector being connectable to the lower riser section;

lifting the flowline termination upwardly into operative connection with the rigid connector by jack means mounted between the flowline termination and the yoke assembly; and establishing fluid communication from the subsea well through the fixed riser section and flexible flowline to the surface facility with the flexible flowline depending from the rigid connector at substantially vertical catenary departure angle and with the flowline termination being substantially entirely supported by the rigid connector.

* * * * *